United States Patent [19]

Barberia et al.

[11] 3,931,776

[45] Jan. 13, 1976

[54] METHOD OF MAKING A DOUBLE-WALLED TUBULAR CONTAINER

[76] Inventors: Oscar Barberia, Mariano Pelliza, 2831, Olivos, Buenos Aires; Angel Rogelio Testi, Jose Maria Moreno, 321, Haedo, Buenos Aires, both of Argentina

[22] Filed: July 1, 1974

[21] Appl. No.: 484,884

[30] Foreign Application Priority Data

July 11, 1973 Argentina ..... 249023

[52] U.S. Cl. ..... 113/120 XY; 113/120 D; 228/18; 228/144

[51] Int. Cl.[2] ..... B21D 51/36

[58] Field of Search ..... 222/92, 107; 220/63 R; 264/248, DIG. 41; 156/190, 191, 69, 218; 228/18, 144; 113/120 D, 120 XY

[56] References Cited

UNITED STATES PATENTS

| | | | |
|---|---|---|---|
| 2,012,531 | 8/1935 | Goldine | 222/107 |
| 2,383,230 | 8/1945 | Voke | 222/107 X |
| 3,172,571 | 3/1965 | Marchak | 264/DIG. 41 |
| 3,740,306 | 6/1973 | Kosbab et al. | 222/107 X |

*Primary Examiner*—Robert B. Reeves
*Assistant Examiner*—John P. Shannon
*Attorney, Agent, or Firm*—Robert E. Burns; Emmanuel J. Lobato; Bruce L. Adams

[57] ABSTRACT

A method of making a double-walled tubular container by winding plastic sheet material into a sleeve on a cylindrical mandrel with a pair of opposed longitudinal edges of the plastic sheet overlapping. A container top having a skirt is inserted into the plastic sleeve and simultaneously the overlapping edges of the plastic sleeve are heat-sealed and the sleeve is heat-sealed to the skirt of the container top. A thin metal sheet is cut and wound over the sleeve and skirt and is heat-sealed thereto. An ejection outlet stopper is fitted to the container top and the tube is then removed from the mandrel.

3 Claims, 3 Drawing Figures

METHOD OF MAKING A DOUBLE-WALLED TUBULAR CONTAINER

The present invention relates to a method of making a tubular container or simply a tube, having at least a double wall. The tubular container made according to the method of the present invention is formed by a relatively rigid plastic material top part or container cap having a skirt to which there are heat-sealed, without interposition of any element and by fusion of their proper materials or substances, a thin and flexible plastic material sheet sleeve, formed by heat-sealing and fusion of its overlapped longitudinal edge zones. The sleeve and said skirt of the top part are covered by a thin metal sheet or sheath, preferably aluminum, pure or alloyed, printed or in a natural condition, which by heat-sealing of its longitudinal edge zones therebetween comprises, with its included parts, a tubular container or simply a tube having firm, although relatively malleable and collapsible walls. The container is capable of hermetically containing any type of substance, of any nature and density, especially paints and pasty, creamy or adhesive materials, which may suffer transformations or damage through contact with varnishes and any other tegument or substance foreign to the innocuous plastic material containing them.

In order to make the object of the invention more understandable, a description thereof will be given hereinbelow, with reference to the three schematic figures of the drawings attached, which are to be taken as illustrative examples only, in which.

Figure 1:
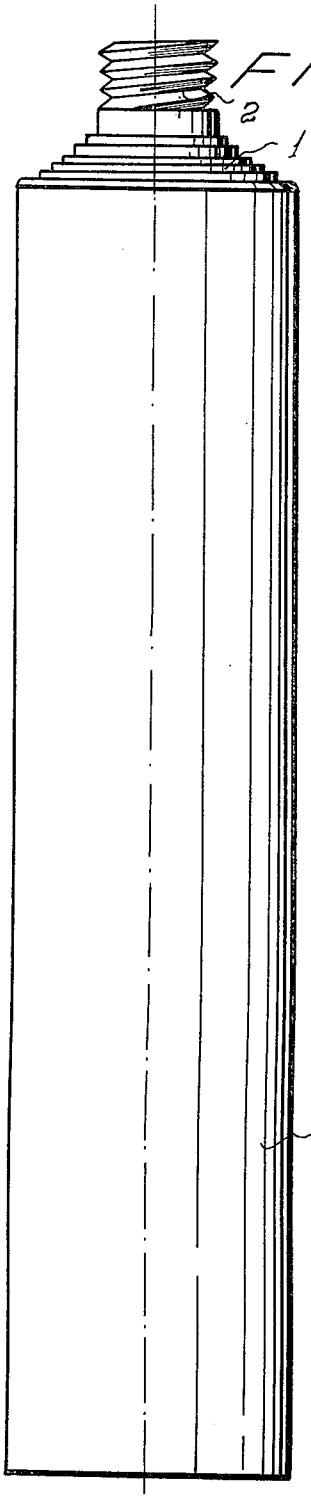
FIG. 1 is an elevational view of a container according to the invention.
Figure 2:
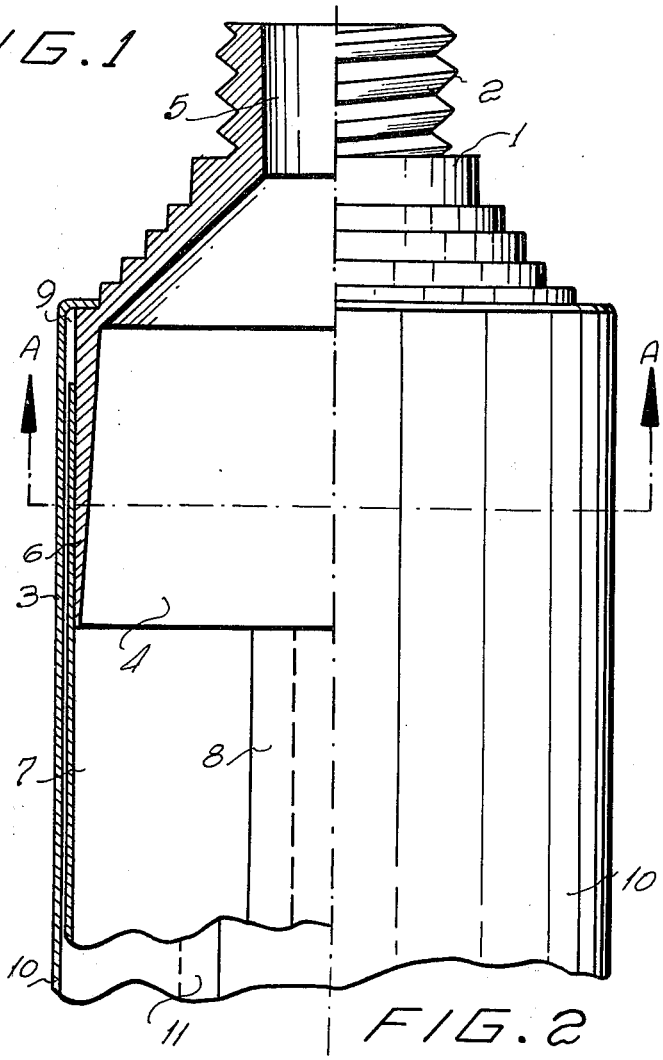
FIG. 2 is a detailed view, in half section and half view, in an enlarged scale, of the top part of the container of FIG. 1.

As shown by the drawings, said tubular container or "tube" is obtained by processing a top part 1, of a thermoplastic substance, having a threaded portion 2, and a skirt 3 forming a chamber 4 which ends in an outlet passage 5, eventually closed or open. The skirt carries on its wall 6 a sleeve 7 heat-sealed thereto, made of a thin sheet plastic material and having its overlapping longitudinal edge portions 8 heat-sealed by fusion of said overlapping materials. The sleeve 7, and wall 9, of the skirt 3 are heat-sealed to a sheath 10 made of a metal sheet, preferably aluminum, printed or in a natural condition and having its edge portions heat-sealed to form a permanent seam. All of these elements thus comprise a unified assembly so that the container will offer the requisite conditions of plasticity, collapsibility, resistance to breakage and eventual puncturing, and at the same time satisfy the requisite innocuity relative to the substances to be contained.

The above shown the construction of the tube-shaped container, which is obtained through the successive steps of the following process:

(a) On a cylindrical mandrel suitable to the purpose, the piece of sheet plastic material 7 is wound, overlapping its longitudinal edges 8, and in the corresponding thermic machine the top portion 1 is coupled to the wound plastic sheet 7, and at the same time simultaneously heat-sealing, by fusion of the overlapping materials, the seam of both edges 8, thus forming sleeve 7. (b) The thin metal sheet, printed or in a natural condition, preferably aluminum, pure or alloyed, of sheath 10 is cut to size; and (c) said sheet comprising sheath 10 is wound over sleeve 7, overlapping its longitudinal edges 11. (d) The sheath 10 is heat-sealed to the plastic sleeve and edges are heat-sealed 11; (e) the tube is cut to the corresponding size; (f) the top portion ejection outlet stopper is fitted; and (g) the tube is withdrawn from the mandrel. The tube-shaped container is ready for receiving subsequent filling with the substance to be packaged, and for final closing of the bottom end, in a manner already known. It is to be noted that all this is carried out in a continuous production machine, designed for the purpose.

Figure 3:
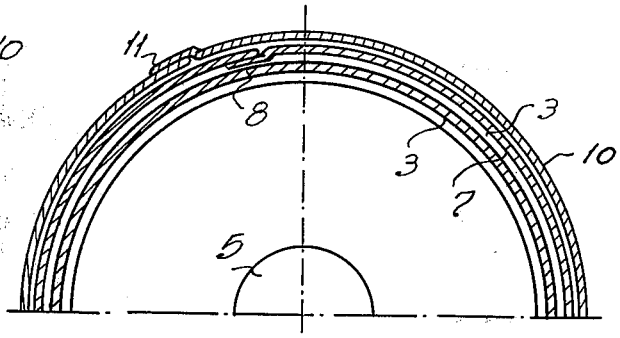
FIG. 3 is a section view taken along line A-A in FIG. 2.

As shown in FIG. 3 the seams 8 and 11 may be positioned so as not to overlap. Consequently, the stresses developed in the seams are at two different circumferential positions along the tube resulting in a strong structure able to withstand internal pressure.

It is quite evident that in practice the container made according to the method of invention may vary in forms, dimensions, thicknesses, top shape, stoppers, printing, etc., but all such variations shall not deviate from the fundamental principles of the invention as defined in the attached claims.

Having thus described and specified the nature and scope of the invention, and the way of carrying it into practice, we claim exclusive right and ownership to:

1. A method of making a double-walled tubular container, comprising:

a. providing a container top having an outlet passage and a skirt portion extending longitudinally of the container top, a plastic sheet having a pair of opposed longitudinal edges, and a metallic sheet having a pair of opposed longitudinal edges;

b. winding said plastic sheet on a cylindrical mandrel to form a tubular plastic sleeve with said pair of opposed longitudinal edges of said plastic sleeve overlapping to define a longitudinally extending seam of the tubular plastic sleeve;

c. inserting said container top skirt within said tubular plastic sleeve;

d. heating said tubular plastic sleeve to simultaneously seal said tubular plastic sleeve to said container top skirt and seal the longitudinally extending seam of said tubular plastic sleeve;

e. winding said metallic sheet on said tubular plastic sleeve to form a tubular metallic sheath overlying said tubular plastic sleeve with said pair of opposed longitudinal edges of said metallic sheet overlapping to define a longitudinally extending seam of the tubular metallic sheath, said metallic sheath overlying a portion of said tubular plastic sleeve sealed to said container top skirt; and f. heating said tubular metallic sheath to simultaneously seal said tubular metallic sheath to said tubular plastic sleeve and seal the longitudinally extending seam of said tubular metallic sheath.

2. A method of making a double-walled tubular container, according to claim 1, wherein said winding said metallic sheet on said tubular plastic sleeve comprises winding said metallic sheet so that the longitudinally extending seam of said tubular metallic sheath does not overlie the longitudinally extending seam of said tubular plastic sleeve.

3. A method of making a double-walled tubular container, according to claim 1, further comprising fitting an outlet passage stopper to said container top, and removing the tube from the mandrel.

* * * * *